United States Patent [19]

Silvia

[11] 4,412,493

[45] Nov. 1, 1983

[54] EXPLOSIVE LOGIC SAFING DEVICE

[75] Inventor: Denis A. Silvia, Aberdeen, Md.

[73] Assignee: The United States of America as represented by the Secretary of the Navy, Washington, D.C.

[21] Appl. No.: 317,961

[22] Filed: Nov. 4, 1981

[51] Int. Cl.[3] ..... F42B 3/10; F42B 15/00

[52] U.S. Cl. ..... 102/275.9; 102/305; 102/701

[58] Field of Search ..... 102/275.1–275.9, 102/305, 202, 202.1, 701, 221, 222, 215

[56] References Cited

U.S. PATENT DOCUMENTS

| | | | |
|---|---|---|---|
| 3,035,518 | 5/1962 | Coursen | 102/305 |
| 3,430,564 | 3/1969 | Silvia et al. | 102/275.9 |
| 3,496,868 | 2/1970 | Silvia et al. | 102/305 |
| 3,669,021 | 6/1972 | Spencer et al. | 102/701 X |
| 3,753,402 | 8/1973 | Menz et al. | 102/701 X |
| 3,768,409 | 10/1973 | Menz et al. | 102/275.9 |
| 3,820,461 | 2/1970 | Silvia | 102/305 |
| 3,973,499 | 8/1976 | Anderson et al. | 102/701 X |

*Primary Examiner*—David H. Brown

*Attorney, Agent, or Firm*—R. F. Beers; W. R. Henderson; D. J. Breh

[57] ABSTRACT

An explosive logic safing device for increasing the safety and reliability of a detonation signal from a fuze to an explosive charge. The safing device is provided with an inlet explosive trail which conveys an inlet detonation signal to an outlet explosive trail and the primary explosive charge. A control explosive trail connects the inlet explosive trail and the outlet explosive trail. A failure explosive trail is connected between the control explosive trail and the outlet explosive trail, and is provided with an explosive logic network for conveying the inlet detonation signal from the inlet explosive trail to the outlet explosive trail when a plurality of detonators are properly initiated. The explosive logic network is also provided with a means for registering the successive initiation failures of individual detonators.

30 Claims, 17 Drawing Figures

EXPLOSIVE LOGIC SAFING DEVICE

BACKGROUND OF THE INVENTION

Many ordnance devices, such as projectiles, mines or bombs, require a fuze to detonate the device at the desired place and time. An important part of the fuze is the safety and arming device (S/A), which contains a group of explosive components called an explosive train. The explosive train may be in an out-of-line (safe) position or in an in-line (armed) position. When in the safe position, accidental initiation of any of the elements of the explosive train must not lead to detonation of the weapon. Conversely, when in the armed position, initiation of the explosive train must always lead to detonation of the weapon.

Prior art methods of safe/arming an explosive device consist of using mechanical devices or exploding bridgewire devices. The mechanical safe/arming devices physically interpose a barrier between the detonator explosive charge and the main charge of the weapon. Mechanical devices have several drawbacks in that environmental degradation over an extended storage period results in an increased failure rate. In addition, as weapon designs become more complex, the requirements placed on mechanical safe/arming devices have resulted in clockword mechanisms which are large, expensive, complex, and thus more unreliable.

Exploding bridgewire devices have no primary explosive charge in the detonator. The bridgewire device initiates the main charge by providing a tremendous pulse of high voltage current to the bridgewire which causes the bridgewire to explode. This initiates a booster which in turn initiates the main explosive charge. Because the exploding bridgewire detonator does not contain any primary explosive, the detonator may be connected directly to a booster or the main charge without the necessity of a mechanical safing mechanism. The drawback of the exploding bridgewire detonator is that it requires an expensive high voltage power supply to provide the necessary current for exploding the bridgewire. This is not generally suitable for conventional ordnance.

The present invention replaces the mechanical safe/-arming mechanisms of conventional warheads and the exploding bridgewire detonators of high voltage systems in nuclear or conventional warheads. The explosive logic safing device can meet all the safety and reliability standards of conventional or nuclear weapons without the use of moving parts or high voltage power systems.

SUMMARY OF THE INVENTION

Accordingly, there is provided in the present invention an explosive logic safing device which meets the extremely high reliability and safety standards of conventional and nuclear weapon safing devices. The explosive logic safing device is provided with an inlet explosive trail having an inlet detonation signal which is conveyed by means of a control (zero detonator failures) explosive trail to an outlet explosive trail and the main explosive charge. The cntrol explosive trail is furnished with an explosive logic network connecting the control explosive trail to the outlet explosive trail.

The explosive logic network is provided with a plurality of explosive logic switches which interconnect a plurality of separate detonators with both the control explosive trail and a failure (one detonator failure) explosive trail. These detonators form a binary, coded sequence of inputs. Upon proper initiation of the detonators, the inlet detonation signal is conveyed on the control explosive trail to the outlet explosive trail and thus to the main explosive charge. When a detonator fails to initiate in the proper time sequence, the explosive logic switches convey the detonation signal to the failure explosive trail. When a predetermined number of detonators (usually two) fail to initiate at their specified times, the detonation signal is extinguished on the failure explosive trail and prevented from reaching the outlet explosive trail. The explosive logic network may also be provided with a means for registering the number of detonators which fail to initiate.

OBJECTS OF THE INVENTION

It is an object of the present invention to provide an explosive logic safing device to meet the extremely high reliability and safety standards of conventional or nuclear weapons.

It is a further object of the present invention to provide a safe/arming device which does not require moving parts or a high current electrical supply.

It is a still further object of the present invention to provide a safe/arming device which has increased reliability, increased storage life, less complexity, greater environmental immunity, and increased safety.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages therein will be readily understood by reference to the following detailed description when considered with the accompanying drawings in which like reference numerals and letters designate like parts throughout the figures and wherein.

DESCRIPTION OF THE PREFERRED EMBODIMENT

Figure 1A:
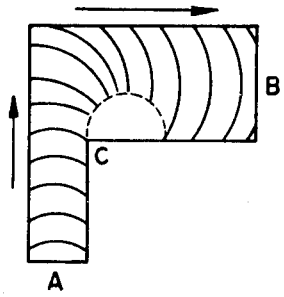
FIG. 1a PRIOR ART
FIGS. 1*a, b,* and *c* illustrate the corner effect in an explosive trail.
Figure 1B:
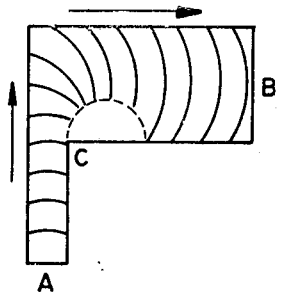
FIG. 1b PRIOR ART
Figure 1C:
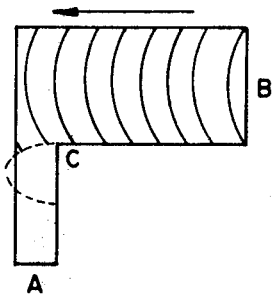
FIG. 1c PRIOR ART

Explosive logic networks for safe/arming devices of conventional and nuclear weapons are based on the "corner effect" principle discovered by Denis A. Silvia and Richard T. Ramsey of the Naval Surface Weapons Center, Dahlgren, Va. The corner effect occurs when a detonation wave propagating in an explosive sheet or trail tries to turn a sharp corner. As illustrated in FIGS. 1*a* and 1*b*, a detonation wave propagating from narrow trail A to wide trail B requires an increased width in trail B to negotiate corner C. As illustrated in FIG. 1*c*, a detonation wave propagating in an explosive trail from wide trail B to narrow trail A in negotiating corner C will turn wide around the corner and run out of room in the narrow explosive trail A and thus extinguish itself.

The principle of the corner effect can be used to establish an explosive diode or one way switch which, in effect, is the situation depicted in FIG. 1*c*. A detonation wave propagating from trail A will be able to turn the corner and proceed on to trail B but a detonation wave initiating in trail B will not be able to negotiate corner C, will extinguish itself, and will not propagate to trail A.

Figure 2A:
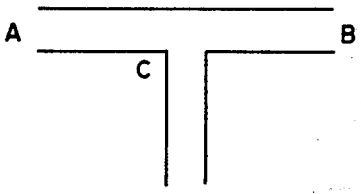
FIG. 2a PRIOR ART
FIGS. 2*a* and *b* illustrate the corner effect in a non-switched null gate.
Figure 2B:
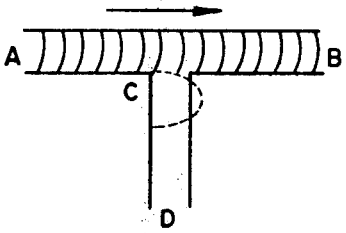
FIG. 2b PRIOR ART
Figure 3A:
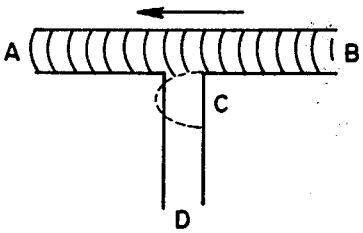
FIG. 3a PRIOR ART
FIGS. 3*a* and *b* illustrate the corner effect in a switching null gate.
Figure 3B:
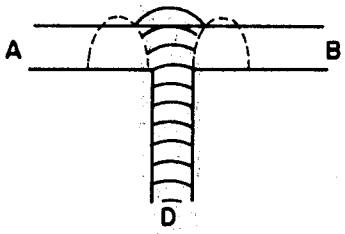
FIG. 3b PRIOR ART

As illustrated in FIGS. 2*a* and *b* and 3*a* and *b*, the corner effect can also be used to create a logic gate. FIGS. 2*a* and *b* illustrate a detonation wave propagating from trail A to trail B which, due to the corner effect, will not negotiate corner C and will not propagate down trail D. As illustrated in FIG. 3*a*, a detonation wave propagating from trail B to trail A will likewise not be able to negotiate corner C and thus will be prevented from propagating down leg or explosive trail D due to the corner effect. As shown in FIG. 3*b*, however, the detonatin wave initiating in trail D will propagate to the intersection of trails A and B and will sever trails A and B and, again due to the corner effect, extinguish itself and not propagate down either trail A or trail B. The logic device described in FIG. 3*b* can be referred to as an explosive null gate. A detonation wave proceeding down trail D will disrupt trails A and B prior to a detonation wave passing along trails A and B and thus prevent passage of the detonation wave from trail A to trail B. In addition, the corner effect will prevent the detonation wave in trail D from turning into either trail A or trail B.

Figure 4:
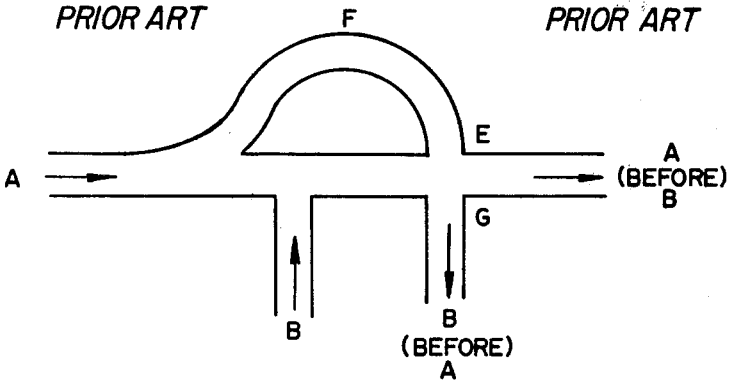
FIG. 4 PRIOR ART
FIG. 4 illustrates an explosive logic switch.

The principle of the corner effect, as embodied in the explosive logic null gate, can be utilized in an explosive logic switch device illustrated in FIG. 4. A detonation wave initiated in trail A prior to the initiation of a detonation wave in trail B (A before B) will result in the wave proceeding down trail A and into outlet trail E. However, if a detonation wave is initiated in trail B of FIG. 4 prior to the initiation of a detonation wave in trail A (B before A), then the detonation wave in trail B will sever trail A at the null gate thus preventing passage of the detonation wave down A to E. Instead, the detonation wave will proceed on explosive loop F, thus bypassing the severed null gate, and proceed down outlet trail G. The detonation wave proceeding through loop F will proceed down trail G and not turn into trail E because of the corner effect. The incorporation of the corner effect, by means of the null gate in the explosive switch illustrated in FIG. 4, provides a logic switch for choosing between two possible sequences of events.

Typical safing systems used in conventional and nuclear warhead applications incorporate both electrical safing and mechanical safing or exploding bridgewired detonator devices. The electrical safing device ensures that a false electrical pulse is not sent to the warhead detonator. The second safing device protects the warhead from accidental functioning of the detonator, whether from electrical or other causes. The subject invention replaces the second safing device with an explosive logic network of secondary explosive (generally but not necessarily) imprinted on or grooved in an inert disc. The explosive logic network is a pattern of explosive trails which are formed on the disc with secondary explosive which due to its characteristics does not require safing. The detonation input to the explosive logic network is provided by a set of detonators. When the correct sequence of detonator function is input to the explosive logic network, a control detonation signal is allowed to propagate through the network and on to the main explosive or warhead. Any other combination of detonator functions is deemed to be an improper combination and extinguishes the control detonation signal in the explosive logic network before it can reach the warhead.

This "combination lock" approach to safing devices allows the selection of the number and combination of detonators which results in a malfunction rate of less than one in a billion. Proper choice of the detonators can also achieve a reliability of 0.999. The explosive logic network combines safety (no warhead function when none is required) and reliability (proper warhead function on command). In addition, the explosive logic network provides for flexibility and adaptability to complex detonation schemes with reduced cost, size, and power requirements.

Figure 5:
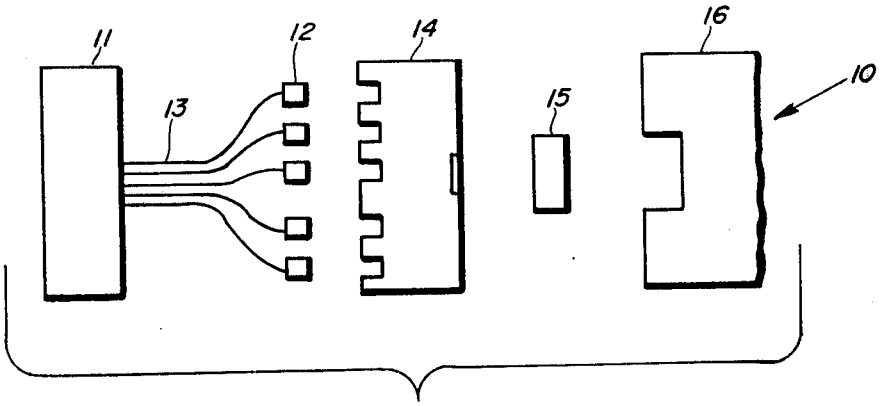
FIG. 5 illustrates how a safe/arm device with the explosive logic network of the subject invention can be incorporated into a missile or other system.

FIG. 5 illustrates the explosive logic network in a safe/arming device 10. The safe/arming device is provided with safe/arming electronics 11 which provide detonation signals by means of electrical conductors 13 to a set of detonators 12. The detonators are positioned in explosive logic network 14 which is constructed as an inert disc having explosive trails forming the explosive logic network. The output of the explosive logic network is used to initiate a booster charge 15 which in turn detonates the primary explosive charge or warhead 16.

The explosive logic safing device receives an input from the detonators in the form of an "object language" and performs syntactical or ordered operations to verify that a valid input combination has been received from the safe/arming electronics by means of the detonators. The safe/arming electronics receives input from the fuze and the explosive logic network validates the fuze's decision to determine whether input signals are from the fuze or from extraneous factors such as the environment.

Figure 6:
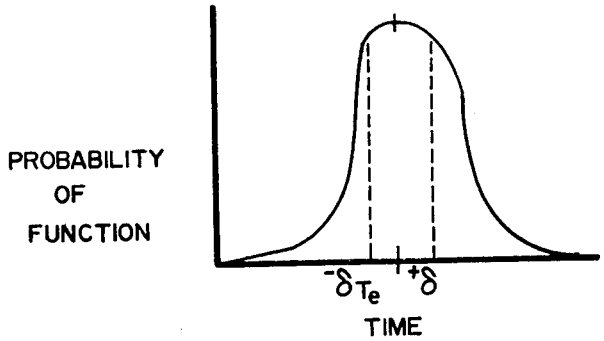
FIG. 6 illustrates a plot of a typical detonator's probability of functioning versus time, showing how reliable ordering of a sequence of detonators relates to the standard deviation of the jitter in detonator function time.

In order to verify a combination signal from the detonators, the explosive logic network must establish a clock signal and a set of time windows. If any detonator functions either too early or too late for its time window, or fails to function, it is deemed to have failed to initiate. The clock signal is established by the first detonator required to function, or the first detonator to function among a minimal set of detonators. For example, if any six detonators in a set of 10 detonators must function to provide a proper combination signal, at least one of the first five detonators must function to establish the clock signal. All the other detonators must then function within the time windows established by the first detonator to function. FIG. 6 illustrates a typical detonator's probability of functioning versus time. In order to obtain a reliability of 0.9 , we must make the time window of the clock wide enough to include Te + or − 3δ, where Te is the mean time to function.

When the time window is opened wide, however, problems begin to arise. In explosives, time translates directly into path length at the rate of approximately ¼" per microsecond. Thus, the size of an explosive logic network will increase beyond practical proportions if the time window is not kept reasonably small. A second problem is that the probability of a functioning detonator accidentally initiating within its time window by chance is increased as the time window is widened. These problems can be alleviated by using shared time delayed paths when constructing the explosive trails of the explosive logic network so as to keep the path lengths of the explosive trails to a minimum.

A set of detonators, when properly sequenced, provides the object language signals to the explosive logic network. This input must meet the safety and reliability standards of conventional and nuclear weapons. Table I shows reliability and safety performance of various detonator sets for some specified detonator function/-malfunction values.

TABLE I

| | | MIN. # FUNCTION/TOTAL # | | |
|---|---|---|---|---|
| | DETONATOR | 3/3 | 4/5 | 6/10 |
| RELIABILITY | .9 | .73 | .918 | .998 |
| | .95 | .86 | .977 | .9999 |
| SAFETY | .1 | .001 | $5 \times 10^{-5}$ | $1.5 \times 10^{-5}$ |
| | .01 | $10^{-6}$ | $5 \times 10^{-8}$ | $2 \times 10^{-10}$ |

Conservative values for single detonator and safety and reliability are 0.01 and 0.95, respectively. The 0.01 refers not to the chance that the detonator will explode, but the chance that it will randomly explode within the correct time window determined by another detonator exploding. Under the assumptions of Table I, a 4/5 detonator set is required for conventional warhead applications and at least 6/10 for nuclear warhead applications. This means that ast least 4 out of 5 possible detonators must function properly to meet the conventional safety and reliability standards, while at least 6 out of 10 detonators must function to meet the nuclear safety and reliability standards. The function of the explosive logic network is to verify that the object signals received are indeed an acceptable combination. This means that in the conventional case, if 4 or more detonators function within the time window established by the first detonator to detonate, the explosive logic netowrk will deliver an output signal to the warhead in 95% of the cases. If this criterion is not met, less than 4 detonators initiate or initiate outside of the time window, then the network will extinguish the inlet detonation signal in 99.999 percent of the cases. This means there would be only one failure per million for conventional applications.

Since the majority of detonators must function, in referring to the explosive logic network it is more efficient to use the inverse or the maximum number of detonators that can be allowed to fail as the design criteria for the network. Thus, in the conventional warhead case not more than one detonator can be allowed to fail without resulting in the detonation signal being extinguished, while in the nuclear case, not more than 4 detonators can fail.

Figure 7:
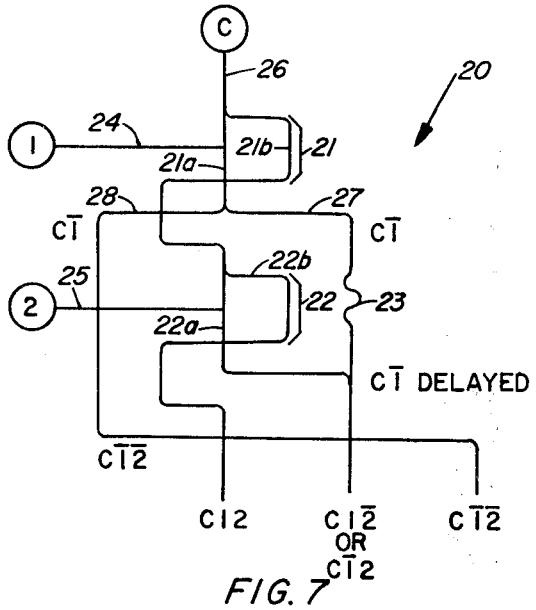
FIG. 7 illustrates a first embodiment of the subject invention.

Referring to FIG. 7 there is illustrated the explosive logic network safing device 20 of the subject invention. The network receives an inlet detonation or control detonation signal originating at C which is conveyed to the logic network on inlet explosive trail 26. The inlet detonation signal from C is conveyed to a control explosive trail having an explosive logic switch 21. Logic switch 21 is formed with explosive loop **21*b* and direct explosive path 21*a*. The switch is also furnished with a null gate 24 which connects a first detonator 1 to explosive switch 21. If detonator 1 is initiated in proper sequence and within its time window, the detonation signal conveyed down null gate 24 will disrupt straight explosive path 21*a* thus preventing the inlet detonation signal from proceeding down path 21*a*. Instead, the inlet detonation signal will follow explosive loop 21*b* and proceed on to a second explosive logic switch 22**.

If, however, detonator 1 does not initiate within its proper sequence, the inlet detonations signal will proceed down straight explosive path **21*a* and cut off explosive loop 21*b* thus preventing a detonation signal from propagating to second explosive swith 22. The signal conveyed down explosive path 21*a* will travel into diverging explosive paths 27 and 28**.

As illustrated in FIG. 7, a second detonator 2 is connected to second explosive logic switch 22 by a null gate 25. Explosive logic switch 22 is provided with an explosive loop **22*b* and a straight explosive path 22*a*. If detonator 1 has functioned properly, and a detonation signal has been conveyed from explosive switch 21 to explosive switch 22, and detonator 2 also functions properly, null gate 25 will disrupt straight explosive path 22*a* of explosive logic switch 22. This will prevent the detonation signal from being conveyed down straight explosive path 22*a*. Instead, the detonation signal travels on explosive loop 22*b* and is propagated as an output signal at C12. illustrated in FIG. 7. The notation used for the output signal at C12 indicates that the output is a result of detonation signals from C and detonators 1 and 2**.

If, however, detonator 1 failed to function properly and the control inlet detonation signal is diverted into explosive paths 28 and 27, the proper functioning of detonator 2 will cut off explosive trail 28 by means of null gate 25 resulting in further propagation of the inlet detonation signal only in explosive trail 27 which will result in an output signal at $C\overline{1}2$, indicating that detonator 1 failed to function while detonator 2 functioned properly. Notation using a detonator numeral with a line above the numeral indicates that the output is a result of that detonator failing to initiate properly. This output trail also is used if detonator 1 functioned properly and detonator 2 failed to function resulting in an output of $C1\overline{2}$. A third output, $C\overline{12}$, is provided for when neither detonator 1 nor detonator 2 functions properly.

Explosive logic network 20 is also provided with a delay means 23, illustrated in FIG. 7, which provides a time delay in explosive path 27 and thus enables signals conveyed down path 28 to cut off explosive path 27 and yield an output signal $C\overline{12}$ when both detonators 1 and 2 fail. Delay means 23 is an extended path of secondary explosive of a sufficient length necessary to yield the desired time delay.

Figure 8:
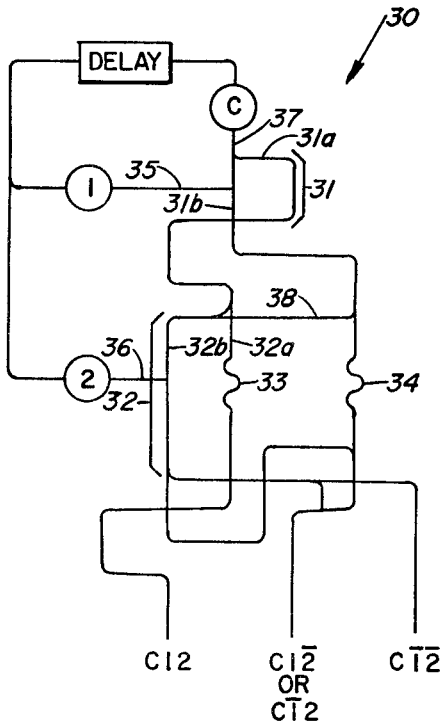
FIG. 8 illustrates a variation of the embodiment of the invention illustrated in FIG. 7.

FIG. 8 illustrates a variation of the explosive logic network depicted in FIG. 7. The network of FIG. 8 uses multi-plexing for eliminating repetitive paths and can be expanded when it is desired to use more detonators, as illustrated in later figures. A delay is illustrated which allows the input or control detonation signal C and the object language signals to the detonators 1 and 2 to originate from a single source.

As in the network illustrated in FIG. 7, the network of FIG. 8 is provided with a first explosive logic switch 31 having an explosive loop 31*a* and a straight explosive path 31*b*. The control or inlet detonation signal from C is conveyed to inlet explosive trail 37 and then to explosive switch 31. A null gate 35 connects first detonator 1 to straight explosive path 31*b* and explosive switch 31. If detonator 1 functions properly straight explosive path 31*b* is disrupted by null gate 35 causing the inlet detonation signal to travel down explosive loop 31*a* and on to a second explosive logic switch 32 shown in a slightly different form than switch 31. Explosive logic switch 32 is provided with a straight explosive path 32*b* and explosive loop 32*a*. A second detonator 2 is connected to straight explosive path 32*b* of explosve logic switch 32 by means of null gate 36. If detonator 2 functions properly, the control inlet detonation signal is conveyed down explosive loop 32*a* to output at C12, indicating that the output is a result of the control detonation and the proper initiation of detonators 1 and 2.

If, however, detonator 1 fails to function properly the control or inlet detonation signal travels down straight explosive path 31*b* and cuts off explosive loop 31*a*. The detonation signal proceeds onward and travels into diverging paths 38 and 34, path 34 is a delay path while 38 carries the detonation signal back into explosive switch 32. If detonator 2 fails to function properly, straight explosive path 32*b* is not disrupted and the detonation signal proceeds down path 32*b* to output $C\overline{12}$, indicating that both detonators 1 and 2 failed to function properly.

If detonator 1 functioned properly, but detonator 2 fails to function the detonation signal traveling through explosive loop 31*a* proceeds into the explosive switch 32 and also into delay path 33. When detonator 2 fails to function the control detonation signal is conveyed through straight explosive path 32*b* to output $C1\overline{2}$, indicating that detonator 1 functioned properly while detonator 2 failed to function. The detonation signal does not output at C12 because the signal in 32*b* will cut off the signal in delay path 33. Likewise, the signal does not output at $C\overline{12}$ because the signal in delay path 34 will be cut off by the signal traveling in 32*b* to $C1\overline{2}$. This output path is also used if detonator 1 fails to function while detonator 2 functions properly, resulting in an output of $C\overline{12}$.

Figure 9:
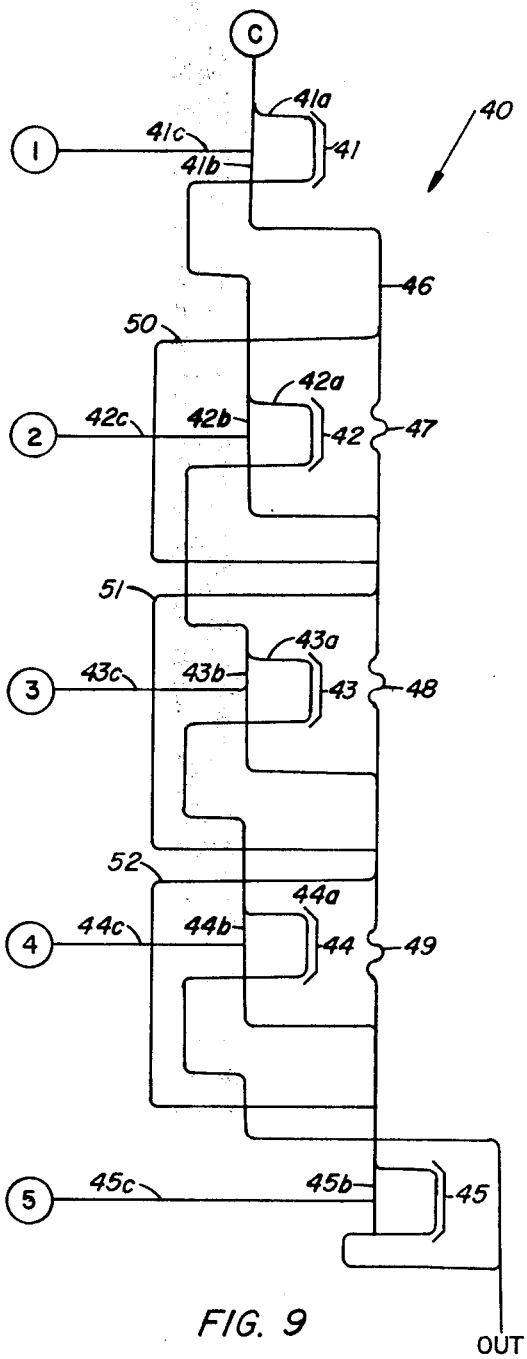
FIG. 9 illustrates a second embodiment of the subject invention.

Referring now to FIG. 9 there is illustrated a five detonator explosive logic network 40 which will satisfy the reliability and safety standards of a conventional warhead. The network is provided with an inlet explosive trail 50 which receives a control or inlet detonation signal originating at C. The control or inlet detonation signal is conveyed by explosive trail 50 to first explosive logic switch 41 which is positioned in a control explosive trail which connects inlet explosive trail 50 to outlet explosive trail 51. Explosive logic switch 41 is provided with an explosive loop 41*a* and a straight explosive path 41*b*. A detonator 1 is attached to explosive logic switch 41 by means of a null gate 41*c*.

If detonator 1 initiates in proper sequence, null gate 41*c* will disrupt straight explosive trail 41*b* and prevent the inlet detonation signal from propagating down 41*b*. Instead, the inlet detonation signal will propagate down explosive loop 41*a* to a second explosive logic switch 42.

If detonator 1 fails to function properly, straight explosive trail 41*b* will not be disrupted and the inlet or control detonation signal will travel down straight explosive trail 41*b* and cut off explosive loop 41*a*. The inlet or control detonation signal will thus be shifted to one failure explosive trail 46 having delay means 47, 48 and 49 positioned in series therein, as illustrated in FIG. 9.

If detonator 1 has functioned properly, however, the inlet detonation signal will propagate by means of explosive loop 41*a* to explosive logic switch 42 which is provided with explosive loop 42*a*, straight explosive trail 42*b*, and null gate 42*c* which connects a detonator 2 with explosive logic switch 42. If detonator 2 functions properly, straight explosive trail 42*b* will be disrupted and the inlet detonation signal will travel down explosive loop 42*a* and propagate onward to explosive switch 43. If detonator 2 fails to function properly, however, straight explosive path 42*b* will not be disrupted and the inlet detonation signal will be conveyed by means of straight explosive path 42*b* to one failure explosive trail 46.

As illustrated in FIG. 9, one failure explosive trail 46 is provided with a plurality of intercepting explosive trails 50, 51 and 52 which diverge from one failure explosive trail 46, intersect and cross the null gate of the respective explosive switch and then intersect explosive trail 46 below the respective explosive switch. In the event that detonator 1 fails to function properly, and the inlet detonation signal is conveyed to the one failure explosive trail 46, interfering explosive path 50 will redirect the inlet detonation signal back across null gate 42*c* of detonator 2. If detonator 2 functions properly the detonation signal conveyed down null gate 42*c* will cut off the signal in interfering explosive path 50 and disrupt straight explosive trail 42*b*. If, however, detonator 2 fails to function properly, the detonation signal carried by interfering explosive path 50 will cross null gate 42*c* and intersect one failure explosive trail 46 as a null gate and disrupt one failure explosive path 46, thus extinguising the detonation signal and preventing it from reaching outlet explosive trail 51.

As illustrated in FIG. 9, explosive logic network 40 is further provided with explosive logic switches 43, 44, and 45 which are connected respectively to detonators 3, 4 and 5. Switches 43 and 44 are provided with delay paths 48 and 49 and interfering explosive paths 51 and 52, respectively. Explosive switches 43, 44 and 45, along with delay paths 48 and 49 and interfering explosive paths 51 and 52 function in the same manner as explosive logic switches 41 and 42 described above. If any of detonators 3, 4 or 5 fail to function properly, the control or inlet detonation signal on the control explosive trail is shifted or conveyed to one failure explosive trail 46. If the inlet detonation signal is alredy propagating on one failure explosive trail 46, due to the failure of either detonator 1 or detonator 2, as described above, then the failure of a subsequent detonator will extinguish the inlet or control detonation signal on one failure explosive trail 46.

One failure explosive trail 46 is provided with delay paths 47, 48 and 49 so as to provide a time delay for the detonation signal, if any, propagating on interfering explosive paths 50, 51 and 52 to reach the corresponding null gate 42*c*, 43*c* and 44*c* and intersect the one failure explosive trail thus extinguishing the inlet detonation signal.

The explosive logic network illustrated in FIG. 9 provides a means for conveying a detonation signal to a conventional warhead if at least 4 out of 5 detonators function properly.

Figure 10A:
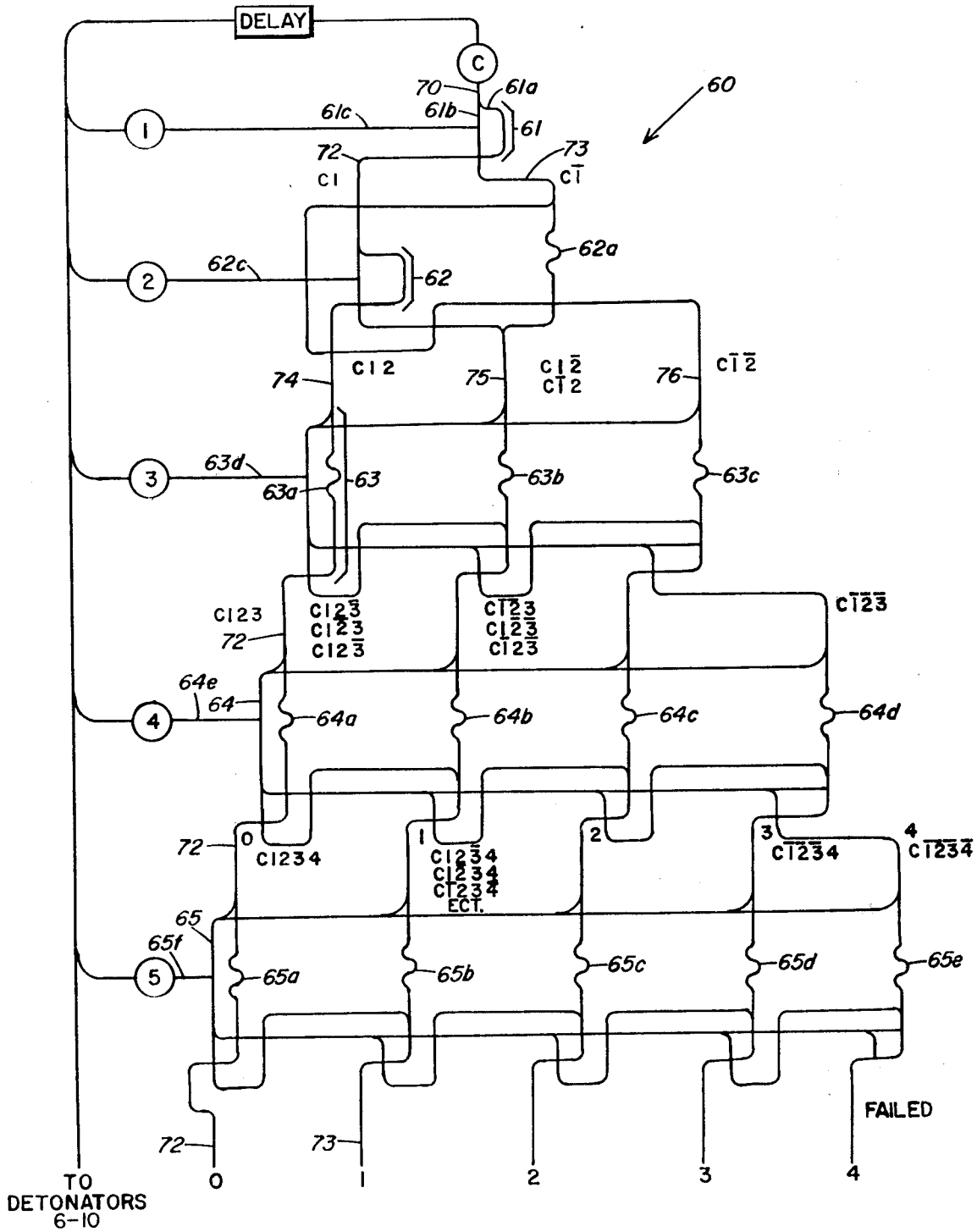
FIGS. 10*a* and *b* illustrate a third embodiment of the subject invention.
Figure 10B:
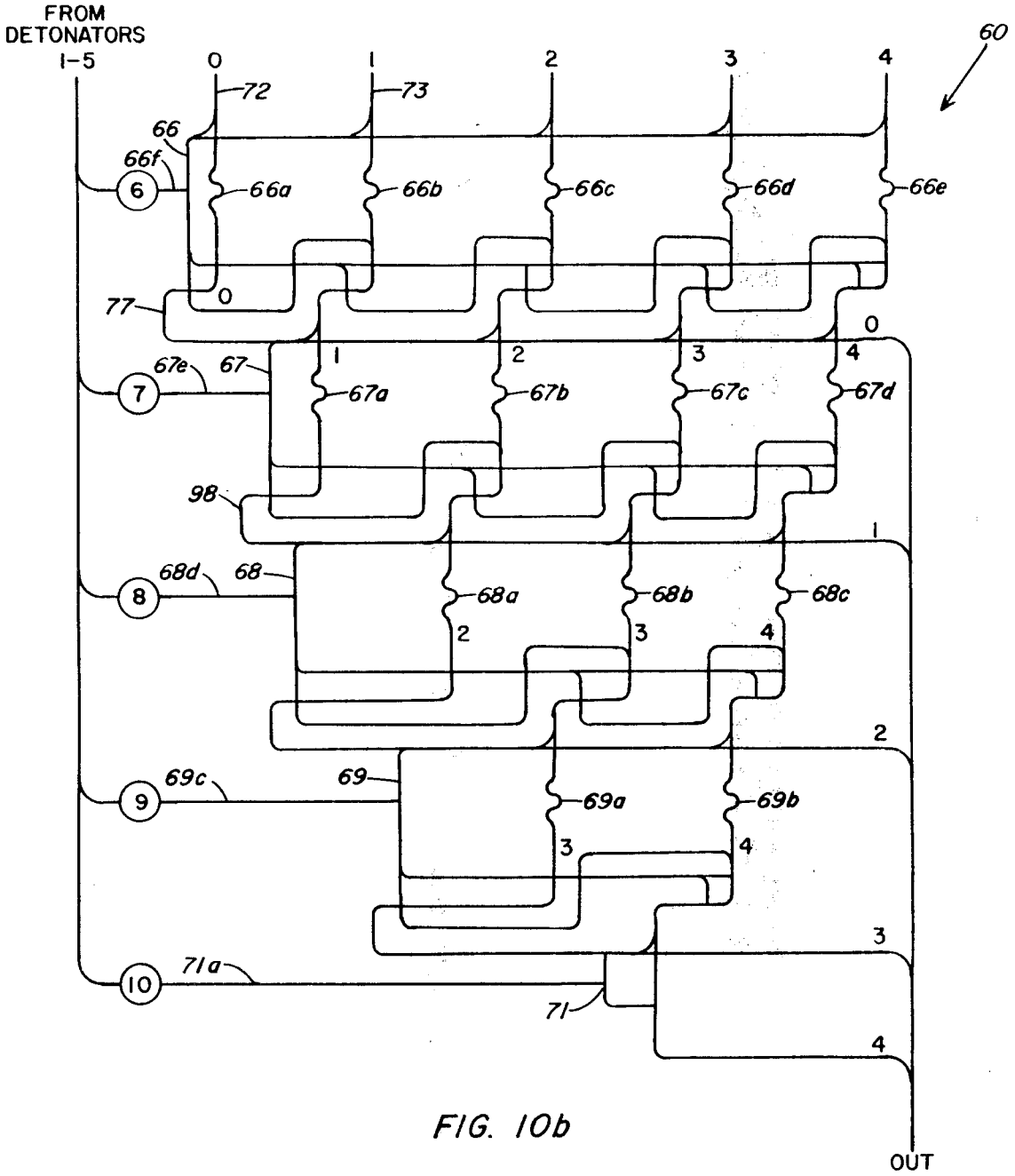

Referring now to FIGS. 10*a* and 10*b*, there is illustrated an explosive logic network which is expanded to provide the reliability and safety requirements necessary for nuclear applications. As illustrated, the explosive logic network of FIGS. 10*a* and 10*b* is expanded to register the number of detonators which fail in a ten detonator set with the proper functioning of at least six detonators required to generate a detonation signal from the inlet explosive trail to the outlet explosive trail. It is to be understood that the network of FIGS. 10*a* and 10*b* can be modified to meet a requirement such as 5 out of 10, 7 out of 10, 6 out of 8, etc.

Explosive logic network 60 is provided with an inlet explosive trail 70 for receiving a control or inlet detonation signal originating at C. Inlet explosive trail 70 conveys the inlet detonation signal to a first explosive logic switch 61 which is provided with explosive loop 61*a*, straight explosive path 61*b*, and null gate 61*c* which connects detonator 1 to straight explosive path 61*b*. If detonator 1 functions properly, null gate 61*c* will disrupt straight explosive path 61*b* and prevent the detonation signal from traveling down straight explosive path 61*b*, causing the inlet detonation signal to propagate down explosive loop 61*a* and into zero failure explosive trail 72.

As shown in FIG. 10*a*, zero failure trail 72 conveys the detonation signal to a second explosive logic switch 62 which is connected to detonator 2. If detonator 2 functions properly, zero failure explosive trail 72 conveys the inlet detonation signal to a third explosive switch 63, which in turn is connected to detonator 3. This arrangement is duplicated for explosive switches 64, 65, 66, 67, 68, 69, and 71, which are connected to detonators 4, 5, 6, 7, 8, 9 and 10, respectively.

If detonator 1 fails to function properly, straight explosive path 61*b* is not disrupted and the inlet detonation signal is conveyed down straight explosive path 61*b* and cuts off explosive loop 61*a* and is conveyed to a one failure explosive trail 73.

As shown in FIGS. 10*a* and 10*b*, successive detonators 2–10 are provided with a plurality of explosive paths and delay means for registering successive detonator failures as the inlet detonation signal is propagated through the explosive logic network. For example, the notation adjacent zero explosive failure path 72 and one failure explosive path 73, C1 and $C\bar{1}$ respectively, indicate that on zero explosive trail 72 the detonation signal is a result of C and detonator 1 functioning properly, while the detonation signal on one failure explosive trail 73 is a result of C and detonator 1 functioning improperly.

On the next tier of explosive logic paths, the notation indicates that explosive path 74 is a result of C and the proper functioning of detonators 1 and 2 while the explosive path 75 is a result of C and detonator 1 functioning properly and detonator 2 functioning improperly. Explosive path 75 also represents a detonation signal for C and detonator 1 functioning improperly and detonator 2 functioning properly. Explosive path 76 represents a detonation signal of C and both detonators 1 and 2 functioning improperly.

This arrangement of explosive paths within the explosive logic network forms a means for registering the number of successive detonator failures as the control or inlet detonation signal proceeds through the explosive logic network. As illustrated in FIG. 10*a* the outputs of the explosive paths of detonator 5 correspond to detonation signals formed by zero failures, one detonator failure, two detonator failures, three detonator failures, or four detonator failures.

Referring to FIG. 10*b*, zero failure explosive trail 72 inputs the inlet detonation signal to explosive logic switch 66 which is connected by null gate 66*f* to explosive logic switch 66. If the detonation signal is propagated on zero failure explosive trail 72 and detonator 6 functions properly, thereby disrupting the straight explosive trail of switch 66, the detonation signal propagates down zero explosive trail 72 and into delay explosive path 66*a*. The detonation signal is conveyed by delay path 66*a* to exit explosive path 77 and to outlet explosive trail 78 which conveys the detonation signal to the primary explosive charge or warhead because at least 6 out of 10 detonators have functioned properly.

If the detonation signal is conveyed on one failure explosive trail 73, meaning one previous detonator failure, for example, and detonator 6 functions properly, the signal is propagated down delay path 66*b* to the next explosive logic switch 67 which is connected to detonator 7. If detonator 7 functions properly, null gate 67*e* will disrupt the straight explosive path of switch 67 and the detonation signal will remain on one failure explosive trail 73 and be conveyed to exit explosive trail 98 which again will convey the detonation signal to outlet explosive trail 78 due to at least 6 out of 10 detonators functioning properly.

As described above, the explosive logic network 60 illustrated in FIGS. 10*a* and 10*b* will convey a control or inlet detonation signal originating at C to an outlet explosive trail when at least six out of ten of the set of detonators function properly. The multi-tiered network of explosive paths connecting the inlet explosive trail, the outlet explosive trail, and the set of ten detonators, serves as a means for registering the number of successive detonator failures as the control or inlet detonation signal is propagated through the explosive logic network, thus satisfying the high reliability and safety requirements of nuclear warhead applications.

Figure 11:
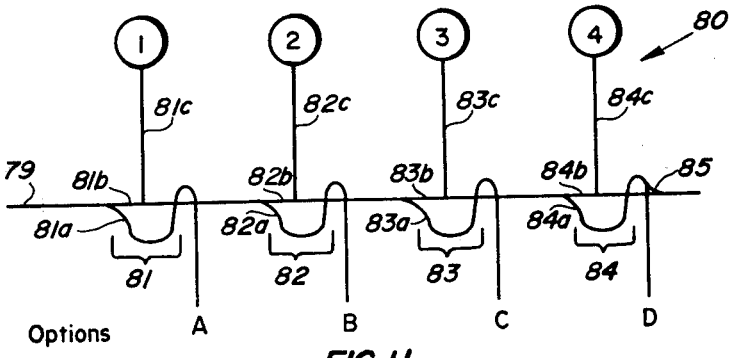
FIG. 11 illustrates a fourth embodiment of the subject invention.
Figure 12:
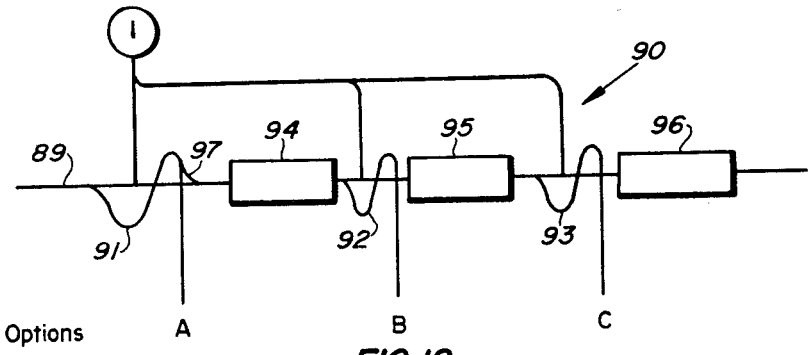
FIG. 12 illustrates a variation of the embodiment of the subject invention illustrated in FIG. 11.

FIGS. 11 and 12 illustrate a simple network for the performance of initiation selectable warhead options which may be used in conjunction with the previously described explosive logic safing devices. FIG. 11 is a network which conserves time and space at the cost of additional detonators while FIG. 12 illustrates a network which utilizes extended explosive paths to increase space and time while conserving detonators.

The network 80 of FIG. 11 receives an inlet detonation signal at control explosive path 79 which is conveyed along the control explosive path to a series of explosive logic switches which are positioned along control explosive path 79. Explosive logic switches 81, 82, 83, and 84 are provided with explosive loops 81*a*, 82*a*, 83*a*, and 84*a*, respectively, and straight explosive paths 81*b*, 82*b*, 83*b*, and 84*b*, respectively. The explosive logic switches are connected to detonators 1, 2, 3, and 4 by null gates 81*c*, 82*c*, 83*c*, and 84*c*, respectively. As illustrated in FIG. 11 a control detonation signal propagated on control explosive path 79 can be directed to any of options A, B, C, or D by the detonation of detonators 1, 2, 3 and 4, respectively. The detonation of a respective detonator will disrupt the corresponding straight explosive path and cause the inlet detonation signal to be conveyed on the corresponding explosive loop to the respective option desired. Curved explosive path 85 is illustrated as connecting explosive loop 84*b* with the control explosive path 79 and may be provided on any of the explosive loops when it is desired to redirect the control detonation signal back into the control explosive trail to provide for additional options when more than one option is desired.

A similar network 90 is illustrated in FIG. 12 with a series of explosive logic switches 91, 92 and 93 positioned on a control explosive trail 89 which receives an inlet or control detonation signal from a safe/arming device, for example. As illustrated in FIG. 12, detonator 1 provides all of the null gate connections for switches 91, 92, and 93. Delay means 94, 95 and 96 are positioned on control explosive trail 89 between the explosive switches and thus, in cooperation with the null gates of detonator 1, determine the sequencing of the options A, B, or C. Also shown in FIG. 12 is a circular explosive trail 97 for redirecting the control detonation signal back in to the control explosive trail when it is desired to employ one or more successive options. Trail 97 may be used with any of the explosive switches illustrated to select the options desired. It is to be understood that the initiation option detonators and networks illustrated in FIGS. 11 and 12 do not have to be safed because they do not directly feed the primary explosive charge of the warhead but merely switch the output from the safe/-arming device to the various warhead options desired.

It is thus apparent that the disclosed explosive logic safing device provides for the high reliability and safety standards required in conventional and nuclear weapons applications. The disclosed explosive logic network provides a safe/arming device which has increased reliability, increased storage life, less complexity, greater environmental immunity, and increased safety without the necessity of moving parts or a high power electrical supply.

Many obvious modifications and embodiments of the specific invention other than those set forth above will readily come to mind to one skilled in the art having the benefit of the teachings presented in the foregoing description and the accompanying drawings of the subject invention, and hence it is to be understood that such modifications are included within the scope of the appended claims.

What is claimed as new and desired to be secured by Letters Patent of the United States is:

1. A device for verifying a detonation signal from a fuze to an explosive charge, comprising:

an inlet explosive trail having an inlet detonation signal;

an outlet explosive trail conveying the detonation signal to the explosive charge;

detonation means initiating at least one code detonation signal, said detonation means being initiated by the fuze; and an explosive logic network connecting the inlet explosive trail, outlet explosive trail and detonation means such that the inlet detonation signal is conveyed from the inlet trail to the outlet trail and the explosive charge by the explosive logic network when the detonation means are initiated.

2. The device as in claim 1 wherein the detonation means comprise a plurality of detonators of N number, said detonators initiating code detonation signals to the explosive logic network such that the inlet detonation signal is conveyed to the explosive charge when at least N−1 detonators are initiated.

3. The device as in claim 2 wherein the explosive logic network comprises:

control explosive trail means between the inlet explosive trail and the outlet explosive trail;

failure explosive trail means between the control explosive trail and the outlet explosive trail;

means conveying the inlet detonation signal from the control explosive trail to the failure explosive trail means when one of the plurality of detonators fails to initiate; and means extinguishing the inlet detonation signal on the failure explosive trail means when more than one detonator fails to initiate.

4. The device as in claim 3 wherein the extinguishing means is provided with an explosive logic outlet.

5. The device as in claim 3 wherein the conveying means is provided with an explosive logic outlet.

6. The device as in claim 3 wherein the conveying means comprise a gated explosive switch connecting each of the plurality of detonators to the control explosive trail and to the failure explosive trail means.

7. The device as in claim 6 wherein the extinguishing means comprise a plurality of delay means in the failure explosive trail means, means parallel to the delay means for extinguishing the inlet detonation signal on said failure explosive trail means, and null means between each of the plurality of detonators and the gated explosive switches for preventing the parallel means from extinguishing the inlet detonation signal upon initiation of each of the plurality of detonators.

8. The device as in claim 1 wherein the detonation means comprise a plurality of detonators of N number, said detonators initiating code detonation signals to the explosive logic network such that the inlet detonation signal is conveyed to the explosive charge when at least N−4 detonators are initiated.

9. The device as in claim 8 wherein the explosive logic network comprises:

control trail means between the inlet explosive trail and the outlet explosive trail;

failure explosive trail means between the inlet explosive trail and the outlet explosive trail;

means conveying the inlet detonation signal from the control explosive trail to the failure explosive trail means when one of the plurality of detonators fails to initiate; and means extinguishing the inlet detonation signal on the failure explosive trail means when more than four detonators fail to initiate.

10. The device as in claim 9 wherein the explosive failure trail means comprise a means registering the number of the plurality of detonators that fail to initiate.

11. The device as in claim 10 wherein the registering means comprise a plurality of detonator failure explosive paths which successively register the number of detonators which fail to initiate.

12. The device as in claim 11 wherein the conveying means shunts the inlet detonation signal to successive detonator failure explosive paths when detonators fail to initiate.

13. The device as in claim 12 wherein each detonator failure explosive path is provided with an explosive logic outlet.

14. The device of claim 12 wherein the extinguishing means terminates the inlet detonation signal on the detonator failure explosive paths when less than N−4 detonators fail to initiate.

15. A safe/arming device for verifying a detonation signal from a fuze to an explosive charge having high reliability and safety, comprising:

an inlet explosive trail having an inlet detonation signal;

an outlet explosive trail;

a plurality of detonators of N number which initiate code detonation signals; and an explosive logic network connecting the inlet explosive trail, outlet explosive trail and plurality of detonators such that the inlet detonation signal is conveyed from the inlet explosive trail to the outlet explosive trail when the code detonation signals indicate that at least M detonators are initiated, said explosive logic network comprising:

control explosive trail means between the inlet explosive trail and the outlet explosive trail;

failure explosive trail means between the control explosive trail means and the outlet explosive trail;

means conveying the inlet detonation signal from the control explosive trail to the failure explosive trail means when one of the plurality of detonators fails to initiate; and means extinguishing the inlet detonation signal on the failure explosive trail means when less than M detonators are initiated.

16. The device as in claim 15 wherein the conveying means comprise a gated explosive switch connecting each of the plurality of detonators to the control explosive trail and to the failure explosive trail means.

17. The device as in claim 15 wherein the extinguishing means comprise a plurality of delay means in the failure explosive trail means, means parallel to the delay means for extinguishing the inlet detonation signal on the failure explosive trail means, and null means between each of the plurality of detonators and the gated explosive switches for preventing the parallel means from extinguishing the inlet detonation signal upon initiation of each of the plurality of detonators.

18. The device as in claim 17 wherein N is 5 and M is 4.

19. The device of claim 15 wherein the failure explosive trail means comprise a means registering the number of the plurality of detonators that fail to initiate.

20. The device of claim 19 wherein the registering means comprise a plurality of detonator failure explosive paths which successively register the number of detonators which fail to initiate.

21. The device of claim 20 wherein the conveying means shunts the inlet detonation signal to successive detonator failure explosive paths when detonators fail to initiate.

22. The device as in claim 21 wherein the extinguishing means terminates the inlet detonation signal on the detonator failure explosive paths when less than M detonators fail to initiate.

23. The device of claim 22 wherein each detonator failure explosive path is provided with an explosive logic outlet.

24. The device of claim 23 wherein N is 10 and M is 6.

25. A device for initiating selectable warhead options, comprising:

an inlet explosive trail having an inlet detonation signal;

a plurality of outlet explosive trails conveying the detonation signal to one or more warhead options; and an explosive logic network connecting the inlet explosive trail and plurality of outlet explosive trails such that the inlet detonation signal can be conveyed to one or more of the warhead options.

26. The device as in claim 25 wherein the explosive logic network comprises a control explosive trail means connecting the inlet explosive trail and the plurality of outlet explosive trails.

27. The device as in claim 26 wherein the explosive logic network further comprises:

a plurality of explosive switch means connecting the control explosive trail means to the warhead options; and detonator means connected to said plurality of explosive switches for activating selectable warhead options.

28. The device as in claim 27 wherein the detonator means comprise:

a plurality of detonators; and a plurality of null gate means connecting the plurality of detonators to the plurality of explosive switches.

29. The device as in claim 27 wherein the detonator means comprise:

a detonator; and a null gate means connecting the detonator to the plurality of explosive switches.

30. The device as in claim 29 wherein the explosive logic network further comprises delay means positioned in the control explosive trail between the explosive switches.

* * * * *